US009534334B2

(12) United States Patent
Alexander et al.

(10) Patent No.: US 9,534,334 B2
(45) Date of Patent: Jan. 3, 2017

(54) LAUNDRY TREATING APPLIANCE WITH A SUSPENSION ASSEMBLY AND A SUSPENSION ASSEMBLY

(71) Applicant: Whirlpool Corporation, Benton Harbor, MI (US)

(72) Inventors: Benjamin E. Alexander, Stevensville, MI (US); Bradley D. Morrow, Stevensville, MI (US); Brenner M. Sharp, Bridgman, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 70 days.

(21) Appl. No.: 14/492,448

(22) Filed: Sep. 22, 2014

(65) Prior Publication Data

US 2016/0083888 A1 Mar. 24, 2016

(51) Int. Cl.
*D06F 37/24* (2006.01)
*D06F 37/26* (2006.01)

(52) U.S. Cl.
CPC ..... *D06F 37/24* (2013.01); *D06F 37/268* (2013.01)

(58) Field of Classification Search
CPC ..... D06F 7/00; D06F 37/00; D06F 37/24; D06F 37/268
See application file for complete search history.

(56) References Cited

U.S. PATENT DOCUMENTS 3,268,082 A * 8/1966 Galin ..... D06F 37/24 210/364
3,373,961 A * 3/1968 Long ..... D06F 37/20 210/364
3,385,541 A * 5/1968 Stelwagen ..... D06F 37/22 210/364
3,548,615 A * 12/1970 Ohnishi ..... D06F 37/203 210/144
3,744,746 A 7/1973 Weir et al.
5,117,659 A * 6/1992 Sharp ..... D06F 37/24 248/568
5,946,946 A * 9/1999 Sharp ..... D06F 37/20 188/129
6,151,930 A 11/2000 Carlson
6,202,806 B1 3/2001 Sandrin et al.
6,340,080 B1 1/2002 Carlson
6,394,239 B1 5/2002 Carlson
6,460,381 B1 * 10/2002 Yoshida ..... D06F 37/203 68/12.04

(Continued)

FOREIGN PATENT DOCUMENTS

CN 1978739 A 6/2007
CN 101078165 A 11/2007

(Continued)

*Primary Examiner* — Michael Barr
*Assistant Examiner* — Benjamin L Osterhout

(57) ABSTRACT

A laundry treating appliance having a cabinet, a wash tub located within the cabinet and defining an interior, a wash basket mounted within the wash tub and defining a laundry treating chamber, and at least one suspension assembly operably coupled to a portion of the cabinet and a portion of the tub such that the tub is suspended from the cabinet and where the suspension assembly includes a suspension rod for attaching to a portion of the tub in a lower part of the cabinet.

14 Claims, 5 Drawing Sheets

(56) References Cited

U.S. PATENT DOCUMENTS

| | | | | |
|---|---|---|---|---|
| 2006/0059960 | A1* | 3/2006 | Hansen | D06F 37/24 68/23.1 |
| 2011/0233375 | A1 | 9/2011 | Ortega Brena | |
| 2011/0247372 | A1* | 10/2011 | Miller | D06F 37/12 68/13 R |
| 2011/0308281 | A1* | 12/2011 | Yu | D06F 37/24 68/212 |
| 2012/0006071 | A1* | 1/2012 | Chang | D06F 37/206 68/140 |
| 2012/0055204 | A1* | 3/2012 | Sun | D06F 13/00 68/132 |
| 2012/0060300 | A1* | 3/2012 | Kim | D06F 23/04 8/137 |

FOREIGN PATENT DOCUMENTS

| | | | |
|---|---|---|---|
| CN | 101135095 | A | 3/2008 |
| IN | 196495 | | 5/2005 |
| JP | 11146993 | A | 6/1999 |
| JP | 2001120885 | A | 5/2001 |
| JP | 2008036229 | A | 2/2008 |
| KR | 2002018348 | A | 3/2002 |
| KR | 100358311 | B1 | 10/2002 |
| KR | 20030034952 | A | 5/2003 |

* cited by examiner

LAUNDRY TREATING APPLIANCE WITH A SUSPENSION ASSEMBLY AND A SUSPENSION ASSEMBLY

BACKGROUND OF THE INVENTION

Laundry treating appliances, such as vertical axis washing machines, typically include a cabinet, a tub in the interior of the cabinet, and a rotatable wash basket mounted in the tub that receives laundry for treatment according to a cycle of operation. The tub may suspend from the cabinet, and may be supported by one or more suspension systems, which may include a spring located at the bottom of the tub. Liquid may interact with the suspension systems, which may contribute to instability, vibration, and noise.

BRIEF DESCRIPTION

An embodiment of the invention relates to a suspension assembly for use in a laundry treating appliance having a tub located within a cabinet, which includes a suspension rod having an upper portion and a lower portion, which is operably coupled to the tub in a lower portion of the cabinet and a spring-damper located along an upper portion of the suspension rod and where at least a portion of the spring-damper is moveably mounted on the suspension rod.

DETAILED DESCRIPTION

Figure 1:
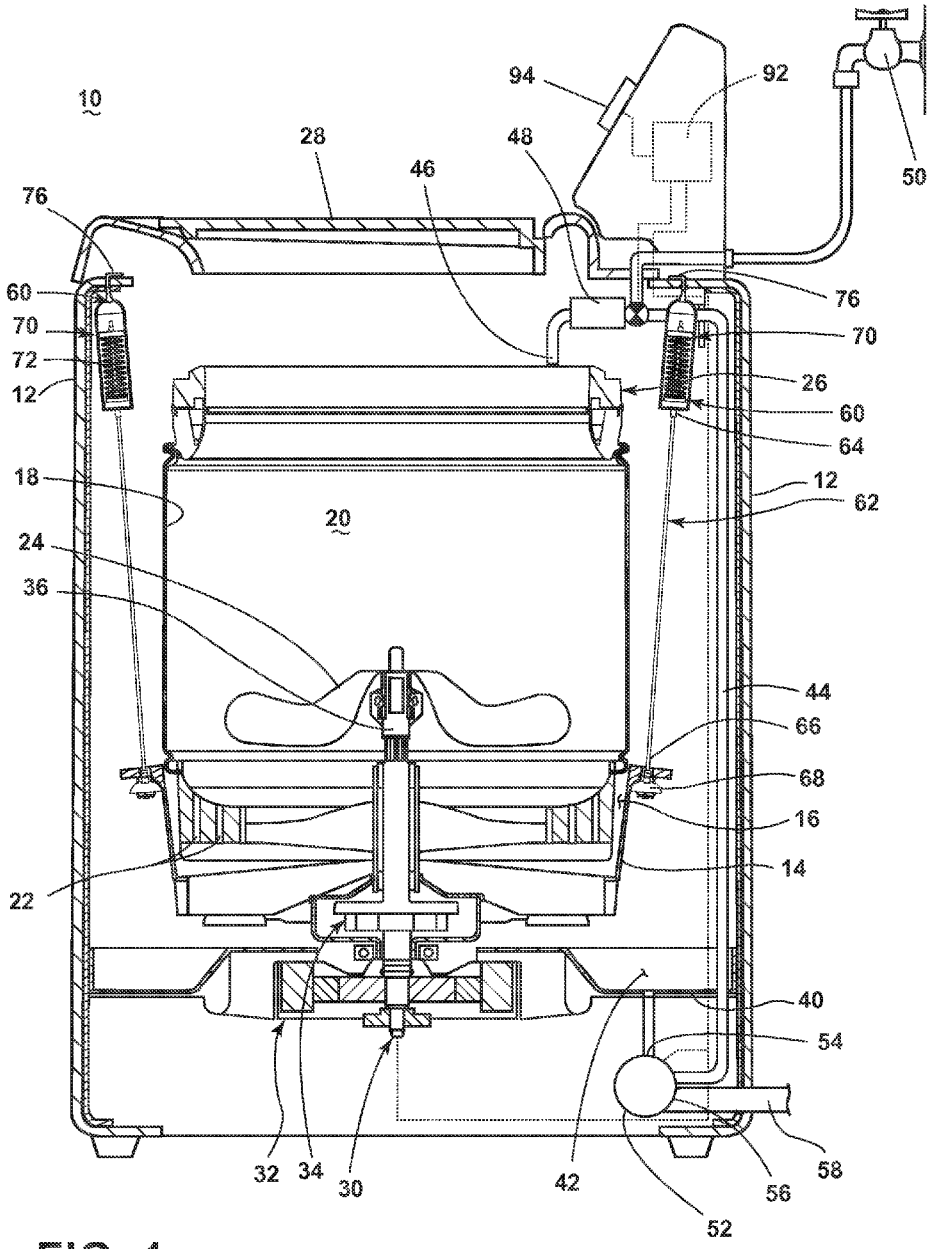
FIG. 1 is a schematic cross-sectional view of a laundry treating appliance according to a first embodiment of the invention.

FIG. 1 illustrates an exemplary laundry treating appliance 10 in the form of a washing machine according to a first embodiment of the invention. While the laundry treating appliance 10 has been illustrated as a vertical axis, top-fill washing machine, embodiments of the invention may have applicability in other laundry treating appliances including by way of non-limiting example a combination laundry washing and drying machine, a non-aqueous laundry treating appliance, etc. The washing machine 10 may include a housing or cabinet 12 and a static wash tub 14, which may be in a fixed position with respect to the cabinet 12. It will be understood that the cabinet 12 may be a frame or chassis with or without panels attached. By "static wash tub," it is not necessarily meant that the wash tub 14 is fixedly integrated to the cabinet 12. For example as illustrated in FIG. 1, the wash tub 14 may be referred to as the static wash tub as long as the wash tub 14 may be in a fixed position with respect to the cabinet 12. For example, the static wash tub 14 may be spaced from the cabinet 12 by a predetermined distance. The static wash tub 14 may define an interior 16 within which a rotatable drum or wash basket 18 may be mounted for rotation about a vertical axis.

The wash basket 18 may define a laundry treating chamber 20 for receiving a laundry load. The wash basket 18 may include one or more drain holes 22 formed on the base portion of the wash basket 18 to discharge the liquid from the wash basket 18 through the one or more drain holes 22. A clothes mover or agitator 24 may be located within the laundry treating chamber 20 and rotatable relative to and/or with the wash basket 18. For example, the agitator 24 may be oscillated or rotated about its axis of rotation during a cycle of operation in order to provide movement to the fabric load contained within the laundry treating chamber 20. A balance ring 26 may be coupled to a top portion of the wash basket 18 for eliminating unbalance from the rotation of laundry items that are non-uniformly distributed in the wash basket 18.

The top of the cabinet 12 may include a selectively openable lid 28 to provide access into the laundry treating chamber 20 through the open top of the wash basket 18.

An electric motor assembly 30 may be provided to drive the wash basket 18 and/or the agitator 24. The electric motor assembly 30 may include, among other things, a motor 32, a transmission 34, and a shaft 36. The electric motor assembly 30 may be operably connected to the wash basket 18 and/or the agitator 24. For example, the shaft 36 may be rotatably coupled to the agitator 24. Alternative motor assemblies with differing configurations than illustrated in the drawings may be used. For example, a direct drive motor with an exterior rotor and an interior stator may be used with or without a transmission, based upon clearance requirements beneath the motor assembly.

A catch basin 40 may be fixedly positioned in the lower portion of the cabinet 12 and may have walls for accommodating a predetermined amount of wash liquid draining from the wash basket 18. While the catch basin 40 may be located within the interior of the cabinet 12, it may be understood that positioning the catch basin 40 exterior of the cabinet 12 may also be possible in another embodiment. The catch basin 40 may form a sump 42 and may be provided with a liquid level sensor for determining the liquid height in the catch basin 40. The catch basin 40 may also be provided with a turbidity sensor for determining the turbidity of the wash liquid received in the catch basin 40.

A spraying system may be provided to supply the liquid, such as water or a combination of water and one or more treating chemistries into the open top of the wash basket 18. The spraying system may be configured to recirculate wash liquid from the catch basin 40, and spray it onto the laundry via a recirculation conduit 44 and a sprayer 46. The nature of the spraying system is not germane to embodiments of the invention, and thus any suitable spraying system may be used with the washing machine 10.

A dispensing system may be provided to the washing machine 10 for supplying treating chemistry to the treating chamber 20 according to a cycle of operation. The dispensing system may include a detergent dispenser 48, which may be a single use dispenser, a bulk dispenser or a combination of a single use and bulk dispenser. As illustrated in FIG. 1, the detergent dispenser 48 may be positioned within the static wash tub 14, and may be disposed vertically above the catch basin 40 for providing one or more treating chemistries to the catch basin 40 by gravity according to a cycle of operation. The detergent dispenser 48 may include a conduit with a predetermined dimension for guiding the supply of one or more treating chemistries to the catch basin 40. The treating chemistries may be in the form of at least one of liquid, powder, pod, compressed puck, or combination thereof.

The treating chemistries may be provided without being mixed with wash liquid from the recirculation conduit 44 or water from the household water supply 50. In another embodiment, the detergent dispenser 48 may be operably configured to dispense a treating chemistry mixed with water supplied from the household water supply 50 through the sprayer 46. The sprayer 46 may be configured to dispense the treating chemistry into the treating chamber 20 in a desired pattern and under a desired amount of pressure. For example, the sprayer 46 may be configured to dispense a flow or stream of treating chemistry into the wash tub 14 by gravity, i.e. a non-pressurized stream. Non-limiting examples of treating chemistries that may be dispensed by the dispensing system during a cycle of operation include one or more of the following: water, surfactants, enzymes, fragrances, stiffness/sizing agents, wrinkle releasers/reducers, softeners, antistatic or electrostatic agents, stain repellants, water repellants, energy reduction/extraction aids, antibacterial agents, medicinal agents, vitamins, moisturizers, shrinkage inhibitors, and color fidelity agents, and combinations thereof.

A recirculation and drain system may be provided to the laundry treating appliance 10 for recirculating liquid within and/or draining liquid from the laundry treating appliance 10. A pump 52 may have an inlet 54 fluidly coupled to the sump 42 and an outlet 56 configured to fluidly couple to the recirculation conduit 44 and a drain conduit 58. It may be understood that the pump 52 may be configured to switch the pumping direction by operating the motor coupled to the pump 52 in the reverse direction. Alternatively, two separate pumps, such as a recirculation pump and a drain pump, may be used instead of the single pump.

Additionally, the spraying system, the dispensing system, and the recirculation and drain system may differ from the configuration shown in FIG. 1, such as by inclusion of other valves, conduits, treating chemistry dispensers, sensors and the like, to control the flow of liquid through the washing machine 10 and for the introduction of more than one type of treating chemistries.

A plurality of suspension assemblies 60 may be provided in the laundry treating appliance 10 for damping the vibrations generated during the rotational movement of the wash basket 18. The suspension assembly 60 may be operably coupled to an upper portion of the cabinet 12 and a portion of the wash tub 14 such that the wash tub 14 may be suspended from the cabinet 12. More specifically, a suspension rod 62 having an upper portion 64 and a lower portion 66 having an attachment 68 may be included in the suspension assembly 60. The attachment 68 may be used for attaching the suspension rod 62 to a portion of the wash tub 14 in a lower portion of the cabinet 12. Further, a spring-damper 70 having at least a portion that may be moveably mounted on the suspension rod 62 may be included and located adjacent a top of the cabinet 12. The spring portion 72 of the spring-damper 70 has been illustrated as a coil spring although any suitable spring element may be utilized.

A hanger 80 may also be included in the suspension assembly 60 and may have a first end 82 operably coupled to the cabinet 12. A second end 84 may extend past the spring-damper 70 and may be moveably coupled to the suspension rod 62. The hanger 80 may be rotatably coupled to the cabinet 12 in any suitable manner such that the hanger 80 may be free to rotate about the suspension rod 62. That the hanger 80 may be free to rotate results in it being primarily loaded in tension and torque loading may be minimized.

Figure 2:
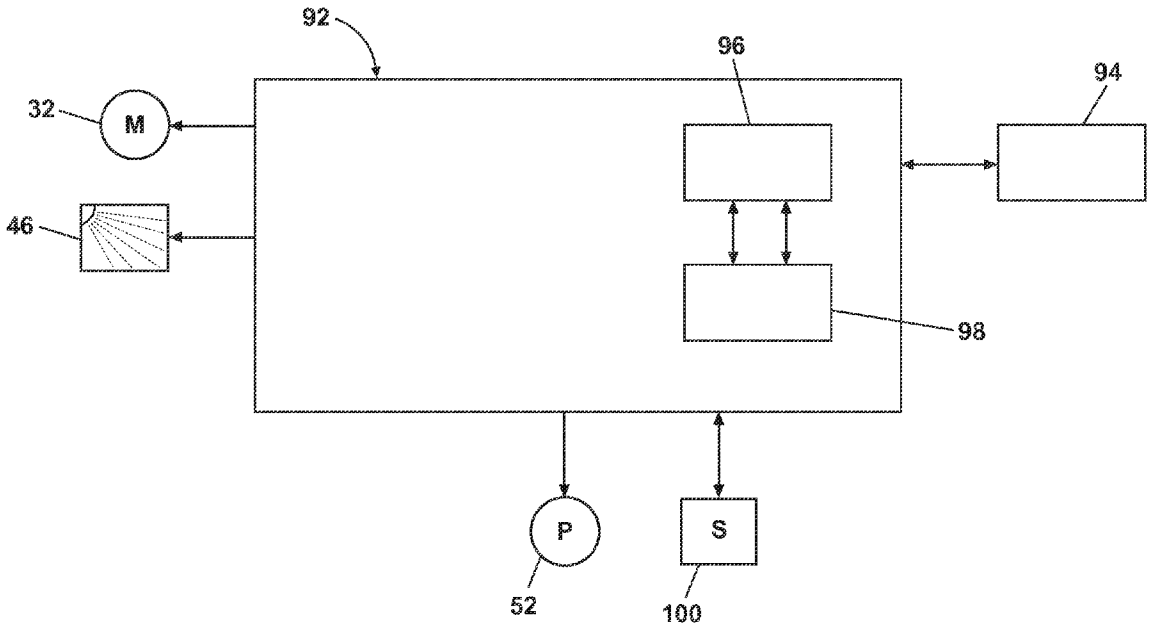
FIG. 2 is a schematic view of a controller of the laundry treating appliance of FIG. 1.

The washing machine 10 also includes a control system for controlling the operation of the washing machine 10 to implement one or more cycles of operation. The control system may include a controller 92 and a user interface 94 that may be operably coupled with the controller 92. The user interface 94 may include one or more knobs, dials, switches, displays, touch screens, and the like for communicating with the user, such as to receive input and provide output. The user may enter different types of information including, without limitation, cycle selection and cycle parameters, such as cycle options. The controller 92 may include the machine controller and any additional controllers provided for controlling any of the components of the washing machine 10. For example, the controller 92 may include the machine controller and a motor controller. Many known types of controllers may be used for the controller 92. The specific type of controller is not germane to embodiments of the invention. It may be contemplated that the controller 92 may be a microprocessor-based controller that implements control software and sends/receives one or more electrical signals to/from each of the various working components to effect the control software. As an example, proportional control (P), proportional integral control (PI), and proportional derivative control (PD), or a combination thereof, a proportional integral derivative control (PID control), may be used to control the various components. As illustrated in FIG. 2, the controller 92 may be provided with a memory 96 and a central processing unit (CPU) 98. The memory 96 may be used for storing the control software that may be executed by the CPU 98 in implementing a cycle of operation using the washing machine 10 and any additional software. Examples, without limitation, of cycles of operation include: wash, heavy duty wash, delicate wash, quick wash, pre-wash, refresh, rinse only, and timed wash. A common wash cycle includes a wash phase, a rinse phase, and a spin extraction phase. Other phases for cycles of operation include, but are not limited to, intermediate extraction phases, such as between the wash and rinse phases, and a pre-wash phase preceding the wash phase, and some cycles of operation include only a select one or more of these exemplary phases. The memory 96 may also be used to store information, such as a database or table, and to store data received from one or more components of the washing machine 10 that may be communicably coupled with the controller 92. The database or table may be used to store the various operating parameters for the one or more cycles of operation, including factory default values for the operating parameters and any adjustments to them by the control system or by user input.

The controller 92 may be operably coupled with one or more components of the washing machine 10 for communicating with and controlling the operation of the component to complete a cycle of operation. For example, the controller 92 may be operably coupled with the motor 30, the pump 52, and the detergent dispenser 48 to control the operation of these and other components to implement one or more of the cycles of operation. The controller 92 may also be coupled with one or more sensors 100 provided in one or more of the systems of the washing machine 10 to receive input from the sensors, which are known in the art and not shown for simplicity. Non-limiting examples of sensors 100 that may be communicably coupled with the controller 92 include: a treating chamber temperature sensor, a moisture sensor, a weight sensor, a chemical sensor, a position sensor, a motor torque sensor, the liquid level sensor, and the turbidity sensor, which may be used to determine a variety of system and liquid characteristics. For example, when the turbidity of one of the wash liquid or rinse liquid in the wash basket 18 or the catch basin 40 satisfies a predetermined threshold, the wash liquid or rinse liquid may be drained by the activation of the pump 52, and fresh water may be supplied to the wash basket 18 from the household water supply 50.

When the wash phase in the wash cycle begins, water may be provided from the household water supply 50. The water may percolate through the laundry items in the wash basket 18, and drain downwardly by gravity through the drain holes 22. The agitator 24 may rotate in at least one of the clockwise or counter clockwise directions for engaging the laundry with the agitator 24 at a predetermined speed according to a cycle of operation. The drain holes 22 may be configured to open, therefore the water may drain through the drain holes 22 when the wash basket 18 may be either in a stationary mode or rotates according to a cycle of operation. Once passing through the drain holes 22, the water may be received in the catch basin 40. The height of wash liquid in the catch basin 40 may be determined by the amount of water initially provided from the household water supply 50 to the treating chamber 20 of the wash basket 18. Therefore, water may be supplied to the wash basket 18 until the water height in the catch basin 40 satisfies a predetermined threshold. For example, an output from the water level sensor may be monitored to determine when the water supply to the wash basket 18 needs to be stopped. The water received in the catch basin 40 may be provided with one or more treating chemistries supplied from the detergent dispenser 48 to the interior of the catch basin 40, and the water and one or more treating chemistries may be physically and/or chemically mixed to each other to form wash liquid. The wash liquid may subsequently be supplied to the inlet 54 of the pump 52 for recirculation through the recirculation conduit 44 back to the laundry items in the wash basket 18. The wash liquid, now a mixture of water and one or more treating chemistries may be percolated through the laundry items in the wash basket 18 while the agitator 24 rotates according to a cycle of operation.

It may be noted that, during the wash phase, the wash liquid may be continuously recirculated from the wash basket 18, through drain holes 22 of the wash basket 18, pump 52, recirculation conduit 44, and then back to the wash basket 18. It may also be noted that treating laundry based on the continuous or semi-continuous percolation of wash liquid may be effective in improving the treating performance of laundry items, compared to a traditional treating step comprising discrete steps of water supply, agitation, and rinsing. The wash phase may be followed by the rinse phase. During the rinse phase, water may be provided to the laundry items in the wash basket 18 through the sprayer 46. Similar to the wash phase, the water supplied from the household water supply 50 may be percolated through the laundry items while the laundry items are agitated by the agitator 24 according to a cycle of operation. During the rinse phase, the water may continuously drain out of the wash basket 18 through one or more drain holes 22, and then recirculate back to the wash basket via the recirculation conduit 44 by the pump 52. One or more treating chemistries for a rinse phase may be provided to the catch basin 40 prior to the onset of or during the rinse phase.

It will be understood that, during the high speed spin extraction phase, the wash basket 18 may be subject to a translational and/or vertical movement from any unbalance of non-uniformly distributed laundry items in the wash basket 18. The translational and/or vertical movement of the wash basket 18 may be transmitted to other coupled components in the form of vibration. In one example, vibration may transmit to the suspension assembly 60. The suspension assembly 60 may move horizontally and/or vertically for damping out the vibrations of the wash basket 18 during the spin extraction phase. In one example, during the vibration damping, the spring 72 of the suspension assembly 60 may be compressed for damping out the vibrations, which may lift up the flexure element 65 in an upward direction.

Figure 3:
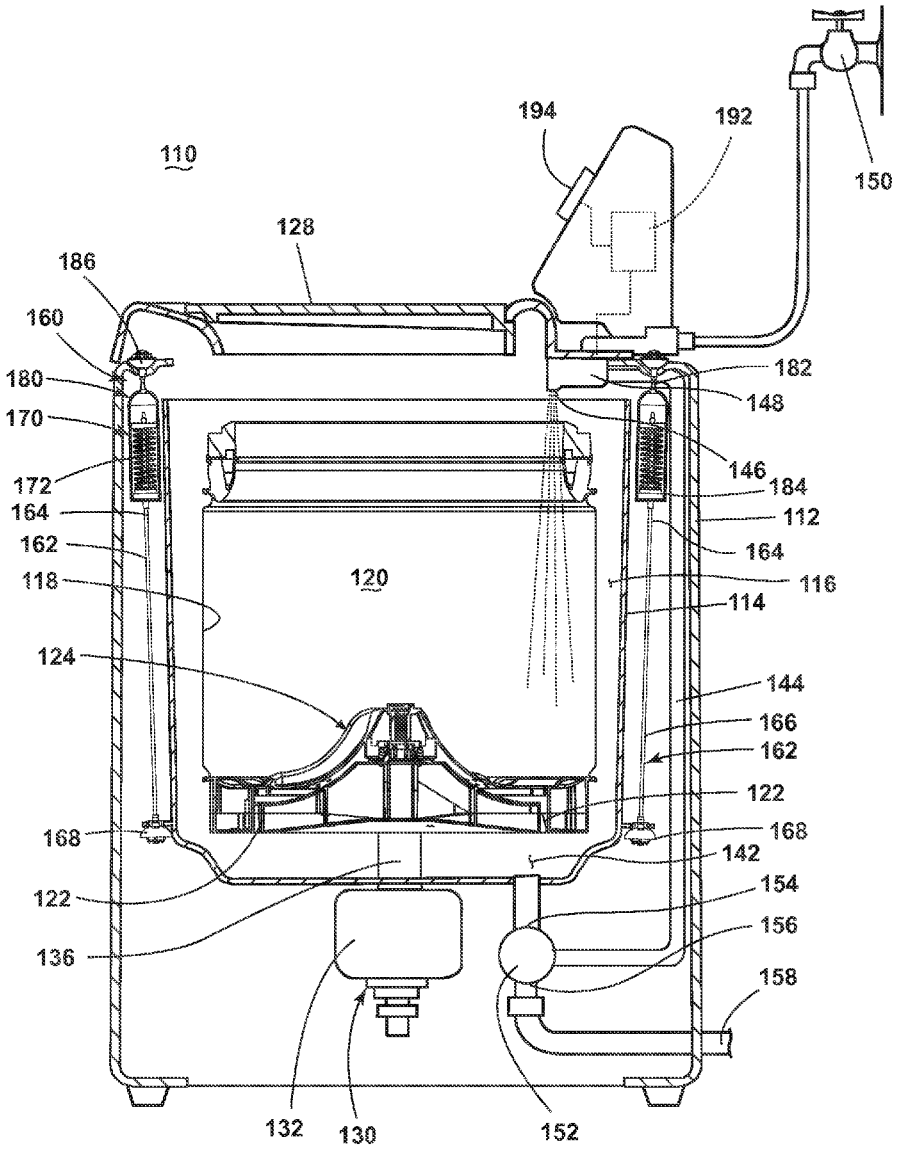
FIG. 3 is a schematic cross-sectional view of an alternative laundry treating appliance according to a second embodiment of the invention.

By way of further non-limiting example, FIG. 3 illustrates an alternative laundry treating appliance 110 according to a second embodiment of the invention. The laundry treating appliance 110 is similar to the laundry treating appliance 10 previously described and therefore, like parts will be identified with like numerals increased by 100, with it being understood that the description of the like parts of the laundry treating appliance 10 applies to the laundry treating appliance 110, unless otherwise noted. Similar to the embodiment described above, the laundry treating appliance 110 has been illustrated as a washing machine having a cabinet 112 and an imperforate tub 114 that defines an interior 116. A drum or perforated wash basket 118 may be located within and rotatable relative to the interior 116 of the tub 114 and may define a laundry treating chamber 120 for receiving a laundry load. A clothes mover or agitator 124 may be located within the laundry treating chamber 120 and rotatable relative to and/or with the wash basket 118.

One of the primary differences between the first embodiment in FIG. 1 and the second embodiment in FIG. 3 is that the tub 114 of the second embodiment is much taller and extends higher around the wash basket. Another difference may be that the cabinet 112 has been illustrated as including rotatable sockets 186 located within its upper portion. In the illustrated example, a hanger 180 may be operably coupled to the rotatable socket 186. In this manner, the hanger 180 may be free to rotate and therefore may be loaded primarily in tension, minimizing the torque loadings.

Figure 4:
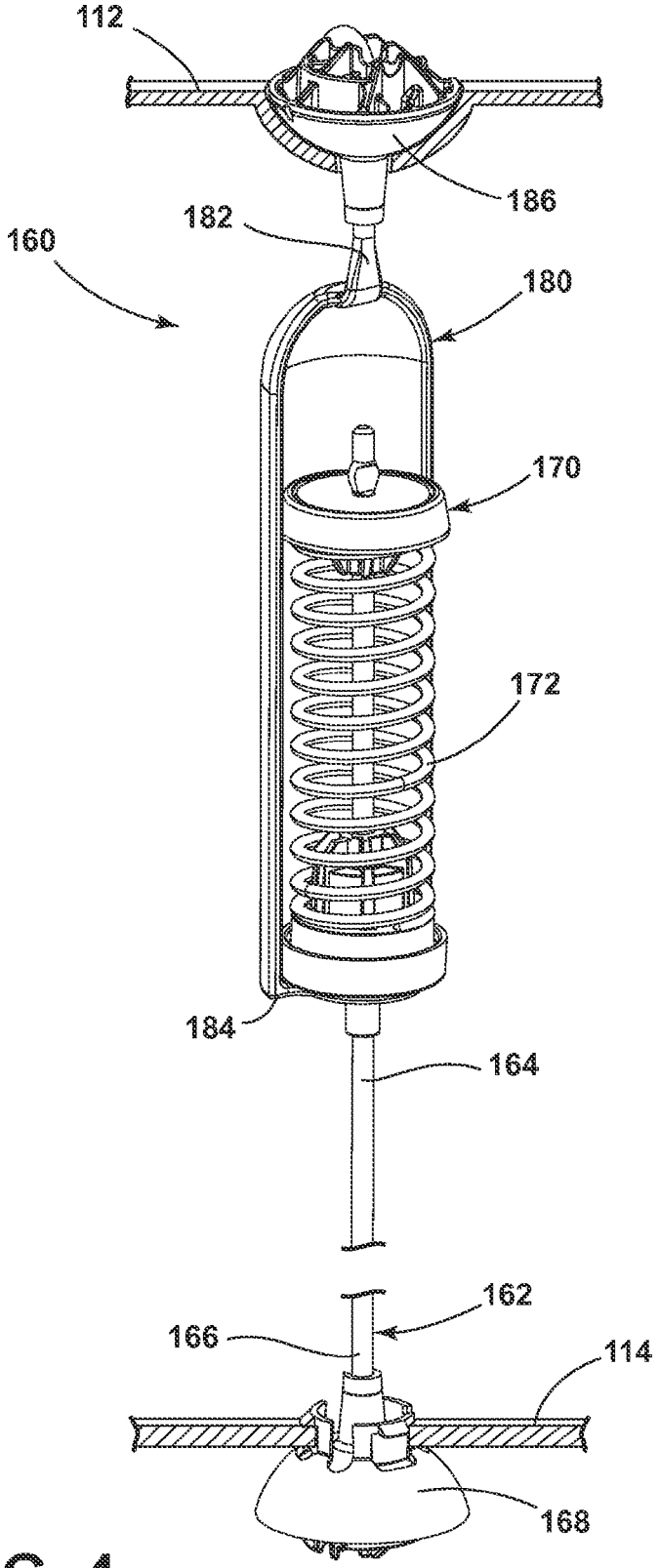
FIG. 4 is a perspective view of an exemplary spring-damper assembly, which may be included in the laundry treating appliances of FIGS. 1 and 3, according to one embodiment of the invention.

FIG. 4 illustrates the exemplary suspension assembly in FIG. 3 in more detail. It will be understood that the suspension assembly 160 may be utilized in any suitable laundry treating appliance including one like that illustrated in FIG. 1. A suspension rod 162 having an upper portion 164 and a lower portion 166, having an attachment 168 may be included in the suspension assembly 160. The attachment 168 may be used for attaching the suspension rod 162 to a portion of the tub 114 in a lower portion of the cabinet 112. Further, a spring-damper 170 having at least a portion that may be moveably mounted on the suspension rod 162 may be include and located adjacent a top of the cabinet 112. The spring portion 172 of the spring-damper 172 has been illustrated as a coil spring although any suitable spring element may be utilized.

A hanger 180 may also be included in the suspension assembly 160 and may have a first end 182 operably coupled to the cabinet 112. More specifically, the hanger 180 may be operably coupled to an upper portion of the cabinet 112, such as through the rotatable socket 186 such that the tub 114 may be suspended from the cabinet 112. A second end 184 of the hanger 180 may extend past the spring-damper 170 and may be moveably coupled to the suspension rod 62.

During operation, the hanger 180 may be free to rotate about the suspension rod 162. The hanger 180 has been illustrated as enclosing at least a portion of the spring-damper 170. It may be contemplated that the hanger 180 may be a stamped housing that at least partially encloses the spring-damper 170. It may be contemplated that the suspension assembly 60 may be formed from any suitable materials. It may also be contemplated that one of more components that may be typically metallic may be formed from a more moisture resistant material.

Figure 5:
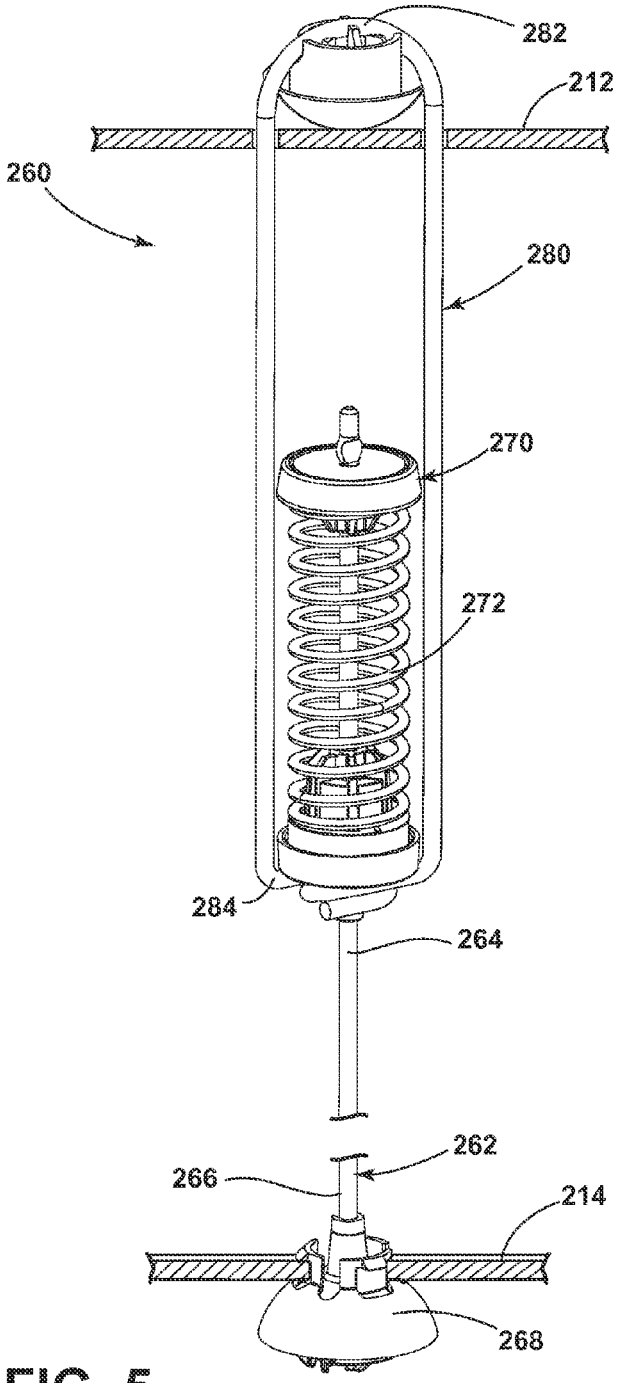
FIG. 5 is a perspective view of an alternative exemplary spring-damper assembly, which may be included in the laundry treating appliances of FIGS. 1 and 3, according to another embodiment of the invention.

By way of further non-limiting example, FIG. 5 illustrates an alternative suspension assembly 260, which may alternatively be utilized in a laundry treating appliance having a cabinet and tub such as the laundry treating appliances of FIGS. 1 and 3, according to another embodiment of the invention. The suspension assembly 260 is similar to the suspension assembly 160 previously described and therefore, like parts will be identified with like numerals increased by 100, with it being understood that the description of the like parts of the suspension assembly 160 applies to the suspension assembly 260, unless otherwise noted. Like the earlier embodiment the suspension assembly 260 may include a hanger 280 having a first end 282 configured to operably couple to a top portion of the cabinet 212 and a second end that extends past the spring-damper 270. The hanger 280 may be free to rotate about the suspension rod 262. One difference may be that the hanger 280 includes a wire form. It may be contemplated that the wire form hanger 280 may locate the spring-damper 270 symmetrically around the suspension rod 262. It will be understood that the wire form hanger 280 need not be formed from a metallic wire and may be made from a moisture resistant material.

It will be understood that the suspension assembly and any included hanger may be formed in any suitable manner. In implementations that utilize a hanger, the hanger may be free to rotate with the suspension rod, which may minimize torque loading. It may be contemplated that the suspension assemblies described above may be used with existing structural interfaces such that they may be used in both new and existing laundry treating appliances.

In contemporary laundry treating appliances, the suspension may be exposed to a harsh environment due to the spring-damper location. In the traditional location at the bottom of the rod, the spring-damper may be heavily exposed to wash solution, which may contain various chemistries and soils as the machine proceeds through a cycle of operation. These components negatively affect parts within the suspension assembly. Water and wash chemistries degrade and wash out the grease within the damper cartridge. Soils such as sand work their way in between moving parts, accelerating wear. Heavy exposure to moisture may cause corrosion of unprotected metal parts.

The above described embodiments provide a variety of benefits including that the spring-damper may be located near the top of the cabinet where the environment may be much more forgiving. Further, the location of the spring-damper near the top of the cabinet allows increased freedom in the placement of the attachment at the lower end of the rod. In contemporary appliances, because the spring-damper extends below the connection point of the tub, clearance was built into the tub to accommodate the spring-damper. This has several drawbacks including that the spacing of the attachment point away from the wall must be increased, which in turn increases the structural requirements of the tub; portions of the tub must be indented in, reducing clearances with the basket which negatively impacts certain aspects of wash (suds formation, etc.) which do not cut into the circular nature of the tub, which may disrupt water flow reducing the pump effectiveness as well as causing more suds to be frothed up potentially leading to suds lock. Conversely, the above described embodiments allow for suspension angles that do not cut into the circular tub allowing it to be larger and rounder, which may result in improved pump performance.

To the extent not already described, the different features and structures of the various embodiments may be used in combination with each other as desired. That one feature may not be illustrated in all of the embodiments is not meant to be construed that it may not be, but is done for brevity of description. Thus, the various features of the different embodiments may be mixed and matched as desired to form new embodiments, whether or not the new embodiments are expressly described. All combinations or permutations of features described herein are covered by this disclosure.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention, which is defined in the appended claims.

What is claimed is:

1. A laundry treating appliance, comprising:
- a cabinet;
- a wash tub located within the cabinet and defining an interior;
- a wash basket located within the wash tub and at least partially defining a laundry treating chamber; and
- at least one suspension assembly operably coupled to a portion of the cabinet and a portion of the tub such that the tub is suspended from the cabinet, comprising:
  - a suspension rod having an upper portion and a lower portion, which is operably coupled to the portion of the tub in a lower portion of the cabinet; and
  - a spring-damper with at least a portion of the spring-damper being moveably mounted on the suspension rod and where the spring-damper is located adjacent a top of the cabinet; and
  - a hanger comprising a frame housing the spring damper and where the hanger has a first end rotatably coupled to the cabinet and where the frame is free to rotate about the suspension rod.

2. The laundry treating appliance of claim 1 wherein the frame comprises a wire form.

3. The laundry treating appliance of claim 2 wherein the wire form locates the spring-damper symmetrically around the suspension rod.

4. The laundry treating appliance of claim 1 wherein the frame comprises a stamped housing.

5. The laundry treating appliance of claim 1 wherein the frame at least partially encloses the spring-damper.

6. The laundry treating appliance of claim 1 wherein the cabinet further comprises a rotatable socket located within its upper portion and the frame is operably coupled to the rotatable socket.

7. The laundry treating appliance of claim 1 wherein the wash basket is mounted within the wash tub for rotation about a vertical axis.

8. The laundry treating appliance of claim 1 wherein the wash tub comprises a static wash tub fixed in position relative to the cabinet.

9. The laundry treating appliance of claim 1 wherein the hanger locates the spring-damper symmetrically around the suspension rod.

10. A suspension assembly for use in a laundry treating appliance having a tub located within a cabinet, comprising:
- a suspension rod having an upper portion and a lower portion, which is operably coupled to a portion of the tub in a lower portion of the cabinet;

a spring-damper located along an upper portion of the suspension rod and where at least a portion of the spring-damper is moveably mounted on the suspension rod; and a hanger comprising a frame housing the spring damper and where the hanger has a first end configured to operably couple to a top portion of the cabinet and a second end that extends past the spring-damper and where the frame is rotatably coupled to the cabinet and free to rotate about the suspension rod.

11. The suspension assembly of claim 10 wherein the hanger comprises a wire form.

12. The suspension assembly of claim 10 wherein the hanger comprises a stamped housing that at least partially encloses the spring-damper.

13. The suspension assembly of claim 10 wherein the hanger locates the spring-damper symmetrically around the suspension rod.

14. A suspension assembly for use in a laundry treating appliance having a tub located within a cabinet, comprising:

a suspension rod having an upper portion and a lower portion, which is operably coupled to a portion of the tub in a lower portion of the cabinet;

a spring-damper located along an upper portion of the suspension rod and where at least a portion of the spring-damper is moveably mounted on the suspension rod; and a hanger comprising a wire form and having a first end configured to operably couple to a top portion of the cabinet and a second end that extends past the spring-damper, wherein the wire form hanger locates the spring-damper symmetrically around the suspension rod wherein the hanger is free to rotate about the suspension rod.

* * * * *